US006592420B1

(12) United States Patent
Onishi et al.

(10) Patent No.: US 6,592,420 B1
(45) Date of Patent: Jul. 15, 2003

(54) MANUFACTURING METHOD FOR A GLASS SUBSTRATE HAVING A PHOSPHOR LAYER USED AS A COLOR CATHODE RAY TUBE FRONT PANEL AND A COLOR CATHODE RAY TUBE MANUFACTURING METHOD

(75) Inventors: Ryouji Onishi, Takatsuki (JP); Hikaru Nishimori, Takatsuki (JP); Hideo Iguchi, Osaka (JP); Naoyuki Tani, Neyagawa (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 575 days.

(21) Appl. No.: 09/592,746

(22) Filed: Jun. 13, 2000

(30) Foreign Application Priority Data

Jun. 18, 1999 (JP) ..... 11-172072

(51) Int. Cl.[7] ..... H01J 9/227
(52) U.S. Cl. ..... 445/45; 427/68; 118/53
(58) Field of Search ..... 427/64; 445/52, 445/45; 118/52, 53, 55

(56) References Cited

U.S. PATENT DOCUMENTS 3,652,323 A * 3/1972 Smith ..... 427/64
4,254,160 A * 3/1981 Raih ..... 427/560
5,259,877 A * 11/1993 Ozaki ..... 118/500
5,316,785 A * 5/1994 Yanai et al. ..... 427/72
5,728,221 A * 3/1998 Kang ..... 118/500

FOREIGN PATENT DOCUMENTS

JP 59186230 10/1984
JP 6203752 7/1994

* cited by examiner

*Primary Examiner*—Kenneth J. Ramsey

(57) ABSTRACT

A glass substrate manufacturing method and a color cathode ray tube manufacturing method manufactures a front substrate on which a phosphor layer is formed. In an application process a phosphor slurry of one color is applied onto an inner surface of a glass substrate on which a phosphor pattern in at least one color has already been formed. Then, in a spreading process, the glass substrate is rotated about an axis located at the approximate center of the inner surface to make the phosphor slurry spread out over its inner surface. Following this, in a draining process the glass substrate is tilted to a first tilt angle of more than 90° to drain excess slurry off the inner surface of the glass substrate, a tilt angle being formed between a vertical axis and an axis orthogonal to an outer surface of the glass substrate. In a spinning process the glass substrate is returned to a second tilt angle smaller than the first tilt angle, and rotated.

13 Claims, 12 Drawing Sheets

MANUFACTURING METHOD FOR A GLASS SUBSTRATE HAVING A PHOSPHOR LAYER USED AS A COLOR CATHODE RAY TUBE FRONT PANEL AND A COLOR CATHODE RAY TUBE MANUFACTURING METHOD

This application is based on an application No. 11-172072 filed in Japan, the content of which is hereby incorporated by reference.

BACKGROUND OF THE INVENTION

1. Field of the Invention

This invention relates to a manufacturing method for a color cathode ray tube (hereafter abbreviated to CRT) and in particular to a manufacturing method for a glass substrate having a phosphor layer on its inner surface, that is used for a front panel of a CRT.

2. Description of Related Art

FIG. 1 is a perspective view of a conventional color CRT that has been partially cut away to show its interior. The color CRT shown in the drawing includes a glass envelope formed by joining together a front substrate 1, a funnel 91 and a neck 92, electron guns 93 that are inserted into the neck 92, a deflection yoke 95 that deflects electron beams 94 emitted by the electron guns 93, a phosphor layer 96 formed on the inner surface of the front substrate 1, color-selecting electrodes 97 positioned at fixed intervals on the side of the phosphor layer 96 nearer to the electron guns 93, and a magnetic shield 98. Here, the edges of the front substrate 1 are surrounded by a low barrier wall, and the term 'inner surface' refers to the curved surface of the front substrate 1, but does not include the surface of the barrier wall.

FIG. 2 is an enlargement in cross-section of part of the inner surface of the front substrate 1, used to illustrate the structure of the phosphor layer 96. As shown in the drawing, a black film 99 with a thickness of around 1 micron is formed in stripes placed at fixed intervals on the inner surface of the front substrate 1. Then, colored phosphor stripes 3, 4 and 5 including phosphor particles with a diameter of 7 to 8 microns in the colors red, green and blue are formed in a specified positional relationship in the intervals between the stripes of black film 99. A reflective layer (not shown in the drawing) is placed on top of this structure, thereby forming the phosphor layer 96. The phosphor stripes 3, 4 and 5 emit light in their respective colors when the electron beams 94 strike the phosphor layer 96 via the color-selecting electrodes 97.

A conventional slurry method is used to form the phosphor layer 96. Such a method is described briefly below, with reference to FIGS. 3A and 3B.

A slurry 2 is formed from a photoresist in which phosphor particles have been suspended, the photoresist consisting of an aqueous solution of polyvinyl alcohol (PVA) to which an aqueous solution of ammonium dichromate (ADC) has been added. As shown in FIG. 3A, the front substrate 1 is positioned so that the inner surface faces upwards, and is tilted slightly at a fixed angle. Then the slurry 2 is poured onto the front substrate 1 while it is rotated slowly in the above-mentioned position, thereby gradually spreading the slurry 2 over the inner surface of the front substrate 1. The arrow in the drawing shows the direction in which rotation is performed. Once the slurry 2 has covered the entire inner surface of the front substrate 1, the front substrate 1 is tilted to the position shown in FIG. 3B and then rotated at high speed, spinning off excess slurry, and thereby forming a phosphor film of an even thickness. This phosphor film is then dried using a heater or warm air. Next, the color-selecting electrodes 97 are fixed at a certain distance from the inner surface of the front substrate 1 and exposed, before being developed using warm water or similar to form a phosphor stripe pattern in a specified color. This process is repeated in turn for each of the green, blue and red phosphors, thereby forming a phosphor pattern having the three specified colors. Following this, an organic film and then an aluminum evaporation film are formed on top of the structure, completing the formation of the phosphor layer 96 for the color CRT.

One important point to consider when using a slurry method to form the phosphor layer 96 is the need to achieve a layer of a uniform thickness when using the spinning process. An uneven phosphor layer will cause disparities in the amount of light emitted by the phosphor layer, thereby generating irregularities of light and shade on the screen surface. Furthermore, if the thicknesses of the phosphor layers for the three phosphors green, blue and red on the front substrate 1 vary at different points on the front substrate 1, the luminance for each color will be different. As a result, the brightness of the three colors will vary from place to place on the substrate 1 and white uniformity will be markedly reduced. One method for improving this situation and increasing white uniformity is described, for example, in Japanese Laid Open Patents Nos. 59-186230 and 6-203752. These documents disclose a technique for achieving an even phosphor layer by a combination of spinning the front substrate 1 with its inner surface facing upwards, and spinning the front substrate 1 with its inner surface facing downwards, once slurry 2 has been poured and spread over the surface of the front substrate 1.

However, the above-described related art technique makes it more difficult to recycle or reuse the excess slurry, and so the method illustrated in FIG. 3A and 3B is generally used to drain off excess slurry, and achieve an even phosphor layer. If this method is used, excess slurry can be recycled using simple recycling equipment, and there is little deterioration in the quality of the recycled slurry.

When the front substrate 1 is positioned horizontally with its inner surface facing upwards, the tilt angle is said to be 0°. Thus, a greater amount of excess slurry will be drained off if a larger tilt angle is used in the draining process. At the same time, however, the phosphor particles deposited on the inner surface of the front substrate 1 are loosened by the force of gravity and so are more likely to drop off. This reduces the amount of friction between the inner surface of the front substrate 1 and the phosphor particles, and accordingly reduces the concentration of phosphor particles on the front substrate 1 when high-speed rotation is performed in the spinning process, as described above.

Furthermore, the centrifugal force generated during the high-speed rotation performed in the spinning process may have a detrimental effect, particularly during the formation of the phosphor pattern for the second and third colors. This effect occurs if the orientation of the centrifugal force generated on these occasions has a certain relationship with the orientation of the grooves created by the phosphor pattern(s) of the colors that have already been applied. When phosphors are applied in a stripe pattern, this occurs when the orientation of the centrifugal force is parallel with the orientation of the stripes, in other words an orientation moving out from the center of the front substrate 1 towards its top and bottom edges (FIG. 4). Alternatively, when phosphors are applied in dot triads, this occurs when the centrifugal force has an orientation moving out diagonally towards the four corners of the front substrate 1. In either of these cases, phosphors are forced out from the central part of the front substrate 1 towards its edges, so that the concentration of phosphor particles in the central part of the front substrate 1 is reduced.

If the front substrate 1 has a large curvature radius, that is if it is virtually flat, the above tendencies are more marked, since the friction between the phosphor particles and the inner surface is reduced, making the movement of phosphor particles from the center of the inner surface toward its edges more likely. Conversely, if the tilt angle of the front substrate 1 in the draining and spinning processes is small, excess slurry which could not be removed is likely to accumulate on the barrier wall surfaces of the front substrate 1. This also causes irregularities in the concentration of phosphor particles to be generated on the inner surface of front substrate 1 during the spinning process. Note that such irregularities in the concentration of the phosphor particles are avoided when the pattern for the first color phosphor is formed, since application of a previous phosphor pattern has not created grooves on the inner surface of the front substrate 1.

SUMMARY OF THE INVENTION

In order to overcome the above problems, the object of the present invention is to provide a means of removing a sufficient amount of excess slurry, while restricting irregularities in the concentration of phosphor particles to form a phosphor pattern having an even thickness.

The above object is realized by a method for manufacturing a glass substrate on one surface of which a phosphor layer has been formed. The glass substrate is used for a front panel of a color cathode ray tube. The manufacturing method includes the following. First, in an application process, a phosphor slurry in one color is applied onto an inner surface of a glass substrate on which a phosphor pattern in at least one color has already been formed. Then, in a spreading process, the glass substrate is rotated about an axis located at the approximate center of the inner surface to make the phosphor slurry spread out over the inner surface of the glass substrate. Following this, in a draining process, the glass substrate is tilted to a first tilt angle of more than 90° to drain excess slurry off the inner surface of the glass substrate, a tilt angle being formed between a vertical axis and an axis orthogonal to an outer surface of the glass substrate. Finally, in a spinning process, the glass substrate is returned to a second tilt angle smaller than the first tilt angle, and rotated.

In this method, the tilt angle for the spinning process is smaller than that for the draining process, enabling a sufficient amount of excess slurry to be removed during the draining process, while restricting irregularities generated in the concentration of phosphor particles during the spinning process.

The most suitable setting for the tilt angle may be expected to vary according to variations in the shape of the glass substrate, materials, and composition of the phosphor slurry, but generally the most desirable setting for the draining processing is a tilt angle that does not exceed 130°. The reason for this is that too large a tilt angle for the draining process will make it easier for phosphor particles to be loosened, thereby causing irregularities in the concentration of phosphor particles in the spinning process. Meanwhile, it is also desirable that the tilt angle in the draining process be no less than 105°. This enables efficient slurry to be drained off.

Furthermore, it is desirable that the glass substrate is rotated in the draining process at a rotation speed slower than the rotation speed used in the spinning process. This prevents excess slurry from remaining in places on the surface of the glass substrate.

For more efficient draining of excess slurry, the tilt angle for the spinning process should exceed 90°. However, this limitation need not apply.

It is further desirable that the tilt angle in the spinning process is no more than 130°. If an angle exceeding 130° is used, irregularities in the concentration of phosphor particles are likely to be generated by phosphor particles being loosened from the surface of the glass substrate.

If the curvature radius of the glass substrate is approximately 10000 mm than the tilt angle should be no more than 110° in the spinning process. A larger curvature radius will make the movement of phosphor particles from the center toward the edges of the inner surface more likely when the glass substrate is rotated at high speed. In this case it is necessary to preserve friction between the inner surface and the phosphor particles, so the tilt angle for the spinning process should be reduced.

Furthermore, the difference between the tilt angles in the draining and spinning processes should be no less than 5° and no more than 20°. If the difference between the tilt angles for the draining and spinning processes is too large, excess slurry adhering to the barrier walls will splatter onto the inner surface when the tilt angle is returned while the high-speed rotation of the spinning process is being performed, thereby generating irregularities in the concentration of phosphor particles.

In the application process, the phosphor slurry is applied to the approximate center of the inner surface of the glass substrate. This ensures that phosphor particles are deposited on the center of the inner surface. Furthermore, in the spreading process, the glass substrate is tilted at a specified tilt angle when rotation is performed. This ensures that phosphor: particles are applied to the entire inner surface. In this case, the tilt angle should be less than 90°.

The object of the present invention is achieved by a color cathode ray tube manufacturing method including the following. In an application process, a phosphor slurry of one color is applied onto an inner surface of a glass substrate on which a phosphor pattern in at least one color has already been formed, the glass substrate being for use as the front panel of a cathode ray tube. Then, in a spreading process the glass substrate is rotated about an axis located at the approximate center of the inner surface to make the phosphor slurry spread out over the inner surface of the glass substrate. Following this, in a draining process the glass substrate is tilted to a specified tilt angle of more than 90° to drain excess slurry off the inner surface of the glass substrate, the tilt angle being formed between a vertical axis and an axis orthogonal to an outer surface of the glass substrate. Then, in a spinning process, the glass substrate is returned to a tilt angle smaller than the specified tilt angle for the draining process, and rotated at a specified rotation speed. Finally, in a cathode ray tube assembly process, after a phosphor layer including phosphors in a specified plurality of colors has been formed on the glass substrate, the glass substrate is fitted together with other glass parts to assemble the cathode ray tube, and a near vacuum is formed in the cathode ray tube. Irregularities in the luminance of a color cathode ray tube manufactured using this method are restricted, and improved white uniformity achieved.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

The following is a description of the embodiments of the invention with reference to the drawings.

First Embodiment

1. Outline Construction of a Phosphor layer Forming Apparatus

Figure 5:
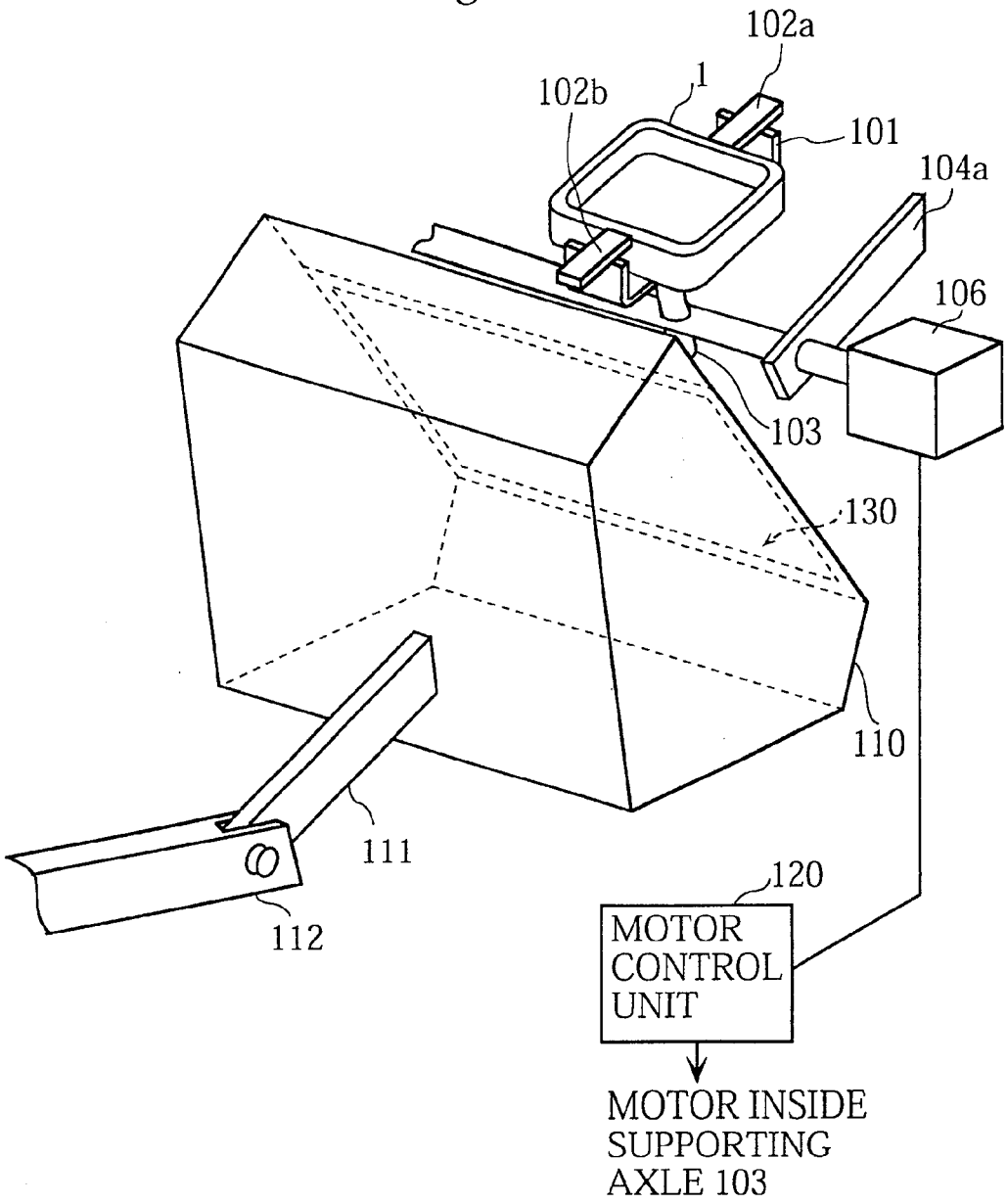
FIG. 5 is a perspective view showing an outline construction for a phosphor layer forming apparatus used in the embodiments of the invention.

First, an outline construction of a phosphor layer forming apparatus used in the present embodiment is explained. FIG. 5 is a perspective view showing an outline construction of the phosphor layer forming apparatus. The phosphor layer forming apparatus has a substrate holding unit for controlling the tilt angle and the rotation speed of a front substrate 1, and a recycling unit including a recycling trough 110 enabling excess slurry generated during draining and spinning processes to be recycled.

Figure 6:
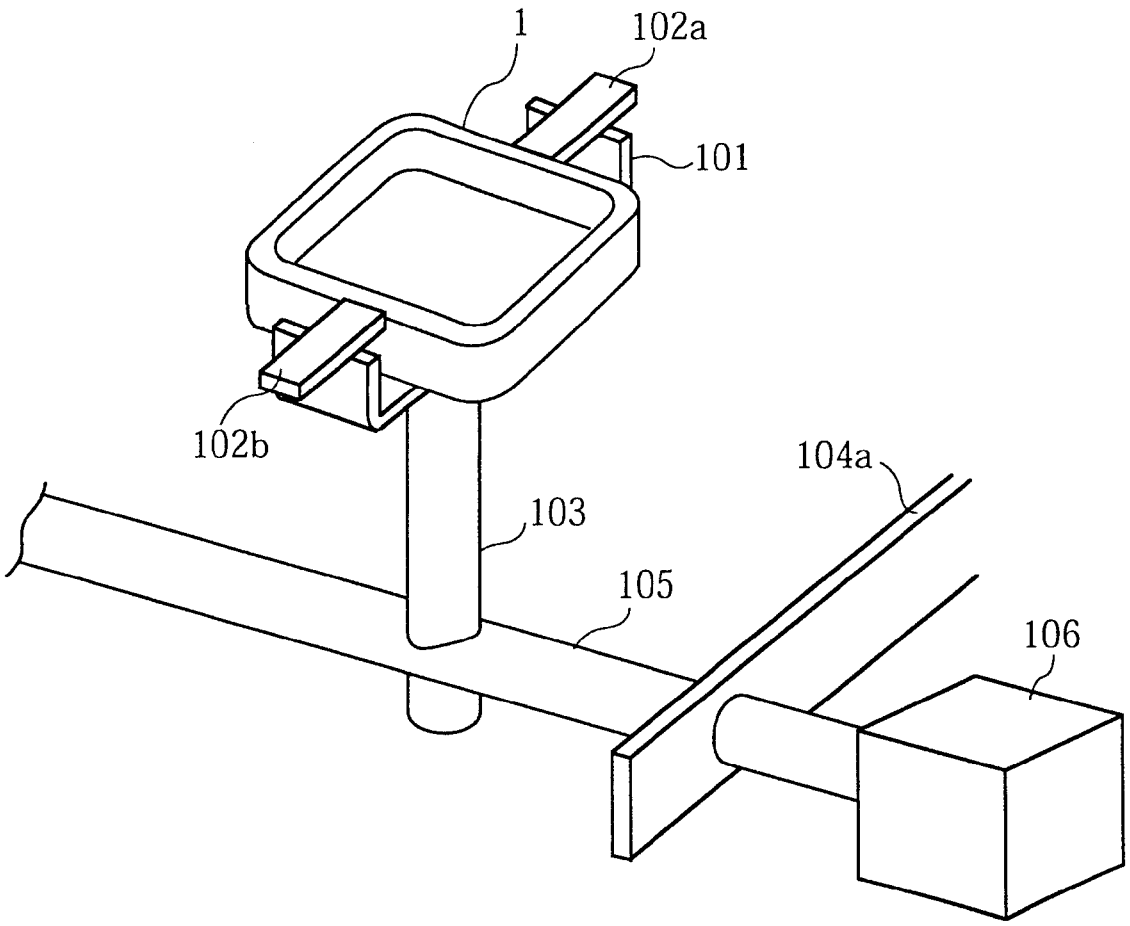
FIG. 6 is an enlargement of a substrate holder 101 in the phosphor layer forming apparatus.

The substrate holding unit has a substrate holder 101, two clamps 102*a* and 102*b* that fix the front substrate 1 to the substrate holder 101, a supporting axle 103 that supports the substrate holder 101 and contains an internalized rotation driving unit (not shown) for rotating the front substrate 1 and the substrate holder 101 at a specified rotation speed, a rotating axle 105 for controlling the tilt angle of the front substrate 1 and the substrate holder 101 via rotation angle control performed by a motor 106, and holding members 104*a* and 104*b* (104*b* is not shown in the drawing) each having one fixed edge, and holding the rotating axle 105 so that it is rotatable. Note that the positional relationship between the supporting axle 103 and the rotating axle 105 is fixed, as is shown in the enlargement of FIG. 6, and the supporting axle does not itself rotate, rotation of the substrate holder 101 being performed by the rotation driving unit inside the supporting axle 103.

The recycling unit is provided with a recycling trough 110 having a recycling opening 130 enabling the excess slurry generated during the draining and spinning processes to be recycled. The recycling unit is equipped with holding members 111 and 112 which change the position of the recycling trough 110 in relation to the substrate holding unit.

Figure 7A:
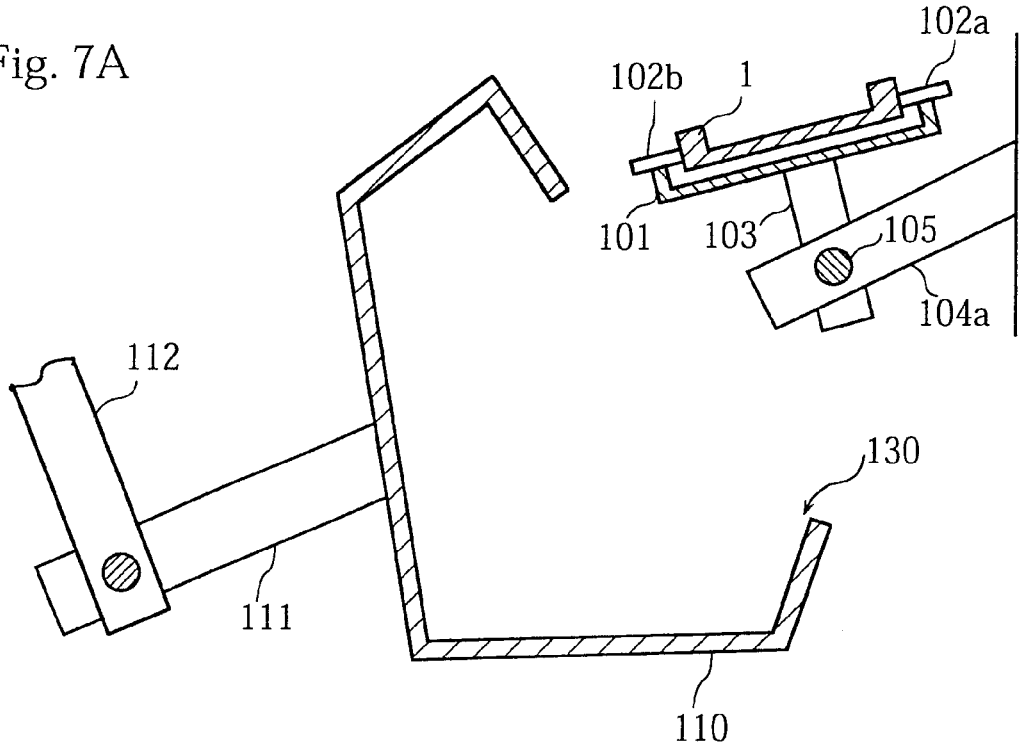
FIG. 7 shows the positional relationship between a panel holding unit and a recycling unit during the application, draining and spinning processes.
Figure 7B:
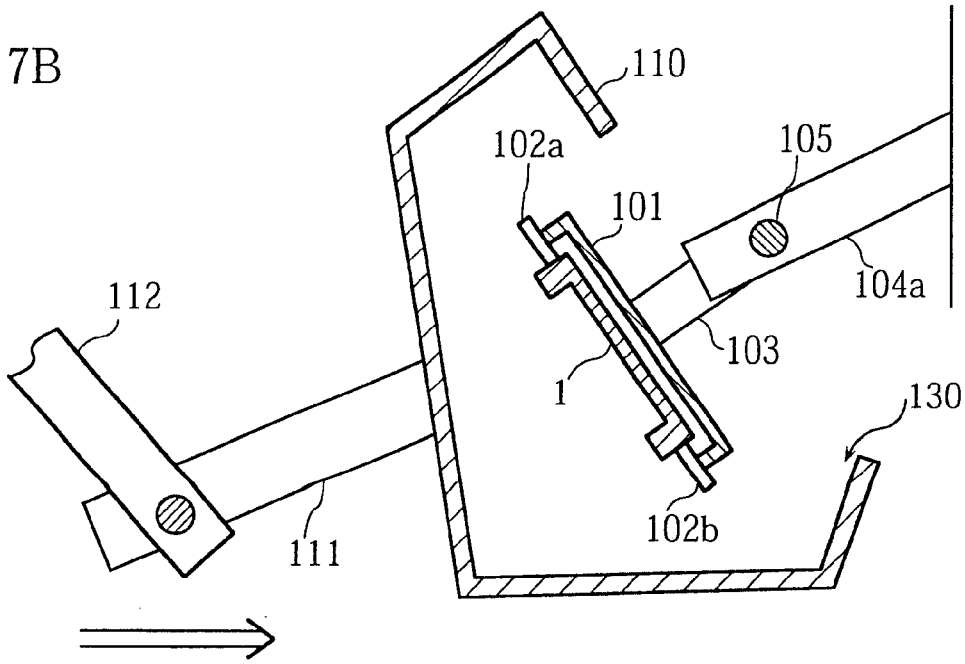

FIG. 7 shows the positional relationship between the substrate holding unit and the recycling unit during the application, draining and spinning processes. As shown in the drawing, the recycling trough 110 is kept away from the substrate holding unit during the application process, as shown in FIG. 7A, but is brought near to the substrate holding unit during the draining and spinning processes. Here, the substrate holder 101 is tilted at a specified angle so that it moves inside the opening 130 of the recycling trough 110, enabling excess slurry to be recycled without waste. The motor 106 and the motor included in the rotation driving unit inside the supporting axle 103 are controlled by a motor control unit 120.

2. Control of Tilt Angle and Rotation Speed

Figure 8:
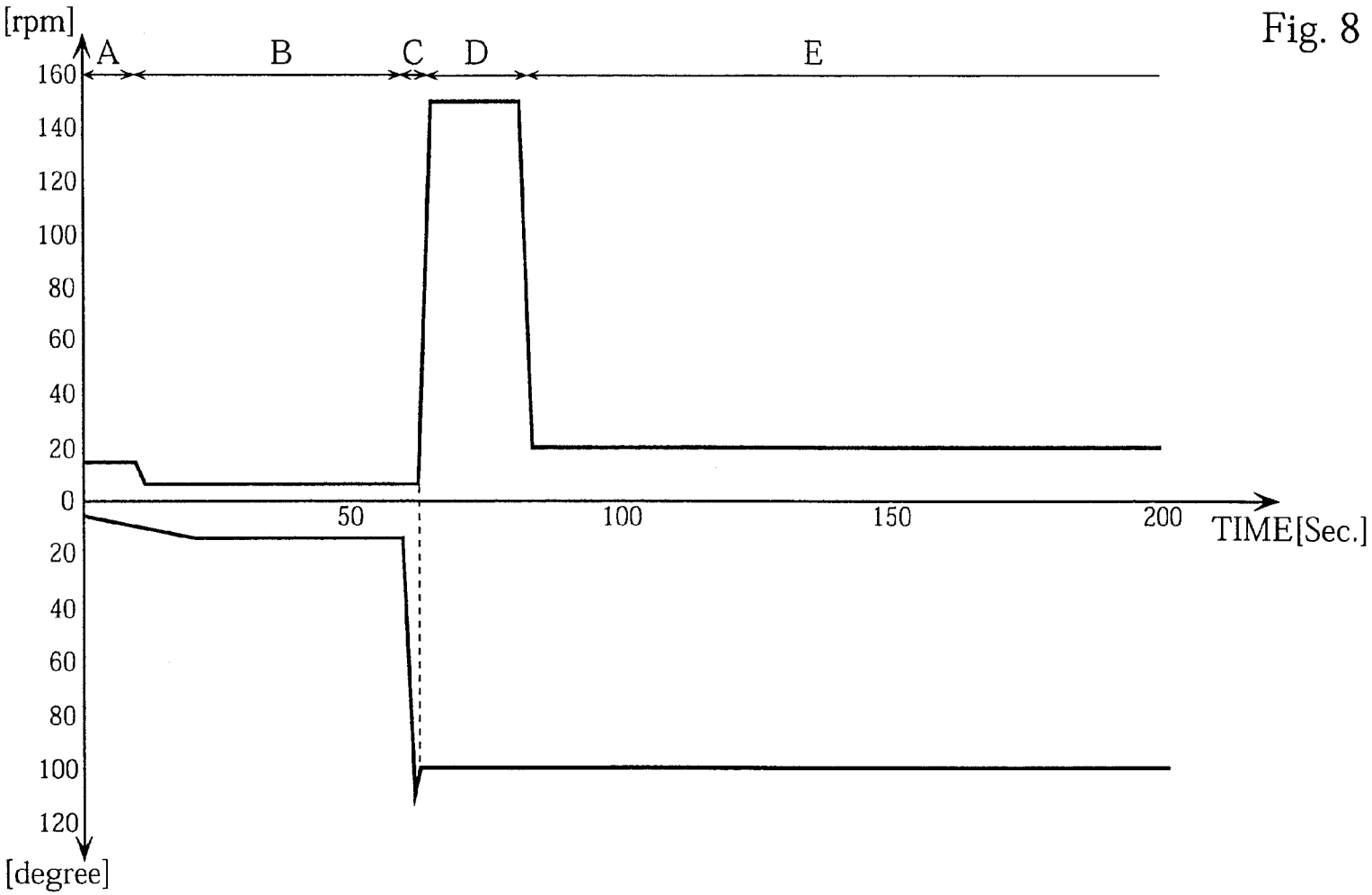
FIG. 8 shows one example of a control of rotation speed and tilt angle during the phosphor layer forming process.

Next, the control of the tilt angle and rotation speed of the substrate holder 101 is explained in an example where the phosphor layer forming method in the invention is performed using a phosphor layer forming apparatus having the above construction. Since, as was previously explained, the front substrate 1 is fixed to the substrate holder 101 using the clamps 102*a* and 102*b*, controlling the tilt angle and rotation speed of the substrate holder 101 is equivalent to controlling the tilt angle and rotation speed of the front substrate 1. FIG. 8 is a timechart illustrating the control of the tilt angle and rotation speed.

Figure 9A:
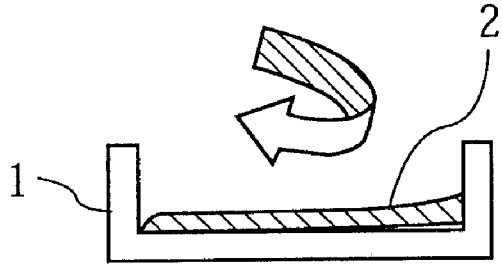
FIGS. 9A to 9C show an outline of the changes in the tilt angle of the front substrate 1 when the phosphor layer formation method of the present invention is used.
Figure 9B:
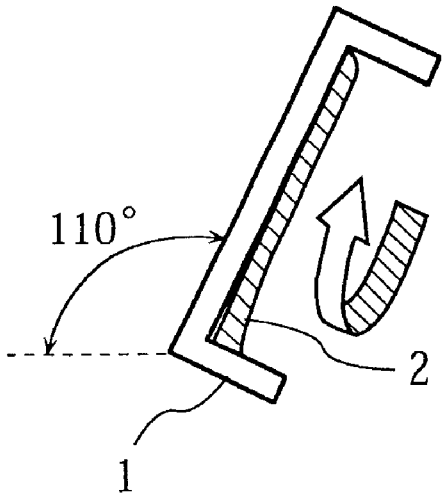
Figure 9C:
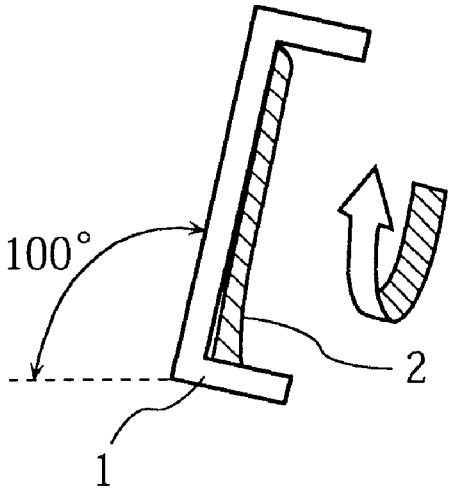

The upper half of the graph in FIG. 8 shows the rotation speed (rpm) of the front substrate 1 and the lower half the tilt angle ($\theta$), both values being plotted along a horizontal axis to illustrate changes over time. FIGS. 9A to 9C show an outline of the changes in the tilt angle $\theta$ of the front substrate 1 in each of the processes performed when the phosphor layer forming method of the present invention is used.

Note that this embodiment describes control of the tilt angle $\theta$ when a phosphor stripe pattern for a third color (red) is applied to a front substrate 1 on which the phosphor stripe patterns for two other colors (green and blue) have already been formed. When forming phosphor stripe patterns in the three colors, the order in which they are formed is completely arbitrary, and green or blue may be applied as the third color in place of red. The method disclosed in the present invention is equally valid in each case.

The external dimensions of the front substrate 1 used in this embodiment are 500 mm (H)×700 mm (L), and the curvature radius of the inner surface is 10000 mm. The edges of the front substrate 1 are surrounded by a low barrier wall. A phosphor slurry 2 to be poured onto the front substrate 1 is a photoresist in which approximately 30% red phosphor particles have been suspended. The photoresist consists of an aqueous solution of polyvinyl alcohol (PVA) to which an aqueous solution of ammonium dichromate (ADC) has been added. In the specification, the tilt angle θ is 0° when the front substrate is placed horizontally with its inner surface facing upwards, and expresses the angle formed between the vertical axis and an axis orthogonal to a screen-face surface of the front substrate 1. However, for the sake of convenience, the tilt angle θ in FIGS. 9B and 9C is shown as the angle between the screen-face surface of the front substrate 1 and the horizontal plane.

The timechart in FIG. 8 shows an example of a control process using the front substrate 1 having the above-mentioned external dimensions and curvature radius, and the phosphor slurry 2. If different components or a slurry with a different composition are used, it may be necessary to change the timing control, and even if identical components and slurry are used, it is not essential to keep strictly to the control pattern shown in FIG. 8. The effect of the invention, (explained later in the specification), is concerned with decreasing the tilt angle θ when moving from the draining process to the spinning process, so the control process should of course be optimized according to variations in parts, substances and environment.

In the control process shown in FIG. 8, the front substrate 1, on which the stripe patterns for the first two colors have already been formed, is tilted gradually from an initial tilt angle θ of 6° to 14°, while being rotated at a rotation speed of 15 rpm. At an early stage in this tilting process, 200 ml of the slurry 2 is poured onto the center of the inner surface of the front substrate 1 (FIG. 8, interval A). The reason for pouring the phosphor slurry 2 onto the front substrate 1 at an early stage in the process, in other words when the tilt angle θ is small, is that this ensures that the phosphor slurry 2 is applied to the central part of the inner surface.

Approximately 10 seconds is taken to pour the phosphor slurry 2 onto the center of the front substrate 1, following which the rotation speed is set at 6 rpm and the tilt angle e is gradually widened, spreading the phosphor slurry 2 over the entire inner surface, excluding the barrier wall surface (application process). Note when the tilt angle θ of the front substrate 1 in the application process shown in FIG. 9A has reached 14° (the tilt angle is not shown in the drawing), the front substrate 1 is rotated at the same angle at a rotation speed of 6 rpm for the next 40 seconds (FIG. 8, interval B). The arrow shown in FIG. 9A indicates the rotation direction, but there is no particular limitation on the rotation direction of the front substrate 1. In addition, the slurry 2 is described as being poured onto the center of the inner surface of the front substrate 1, but the method of application may vary according to the parts and materials used and the conditions of manufacture, so that the slurry 2 may be applied using an injection method, or to an area other than the center of the inner surface.

Following this, the tilt angle θ of the front substrate 1 is moved quickly to 110°, as shown in FIG. 9B, while keeping the rotation speed at a constant 6 rpm, thereby draining off excess slurry (draining process). The tilt angle θ is then returned in one fast continuous motion to 100° (FIG. 8, interval C).

After returning the tilt angle θ to 100°, the rotation speed is raised quickly to 150 rpm, and kept at this speed for 17 seconds, spinning the phosphor slurry 2 to form an even layer and remove further excess slurry (spinning process, FIG. 8, interval )D). In this embodiment, the rotation speed is increased after the tilt angle θ is returned to 100°, but a certain amount of time is required to raise the rotation speed to 150 rpm, so the rotation speed may be increased before the tilt angle θ has been completely returned to 100°.

Once the spinning process has been completed, the rotation speed is dropped to 20 rpm and drying and exposure/developing processes performed with the tilt angle θ maintained at 100° (FIG. 8, interval E), completing the formation of the phosphor layer.

Effect of Phosphor Layer Forming Method in the Present Invention

The following figuratively illustrates the differences in the phosphor layer formed when (a) the tilt angle θ is reduced when moving from the draining process to the spinning process, as in disclosed in the present embodiment, and (b) the tilt angle θ is the same for both processes.

Figure 10:
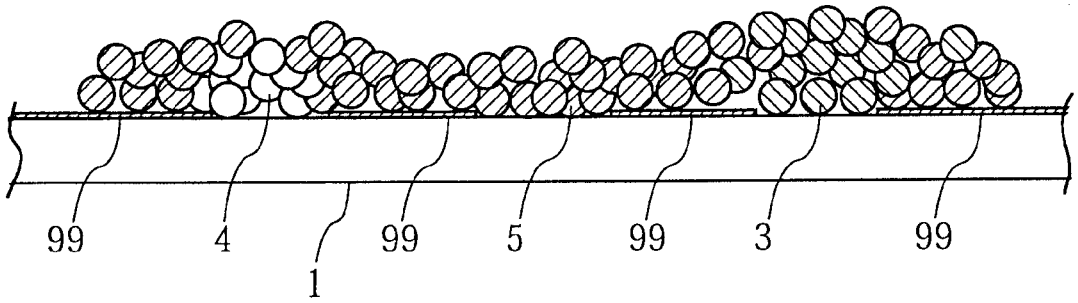
FIG. 10 is an outline cross-section of one part of the front substrate 1, showing the concentration of the phosphor particles 5 having a third color existing after the conclusion of the spinning process performed in the first embodiment of the invention.

FIG. 10 is an outline cross-section of one part of the front substrate 1, showing the concentration of the phosphor particles 5 in a third color after the conclusion of the spinning process, when the phosphor particles 5 are formed into a layer using the method described in this embodiment. FIG. 11 shows a comparative example, in which the draining process and spinning process are performed using the same method and under the same conditions as those in the embodiment, apart from the fact that the tilt angle θ in both processes is 110°.

Figure 1:
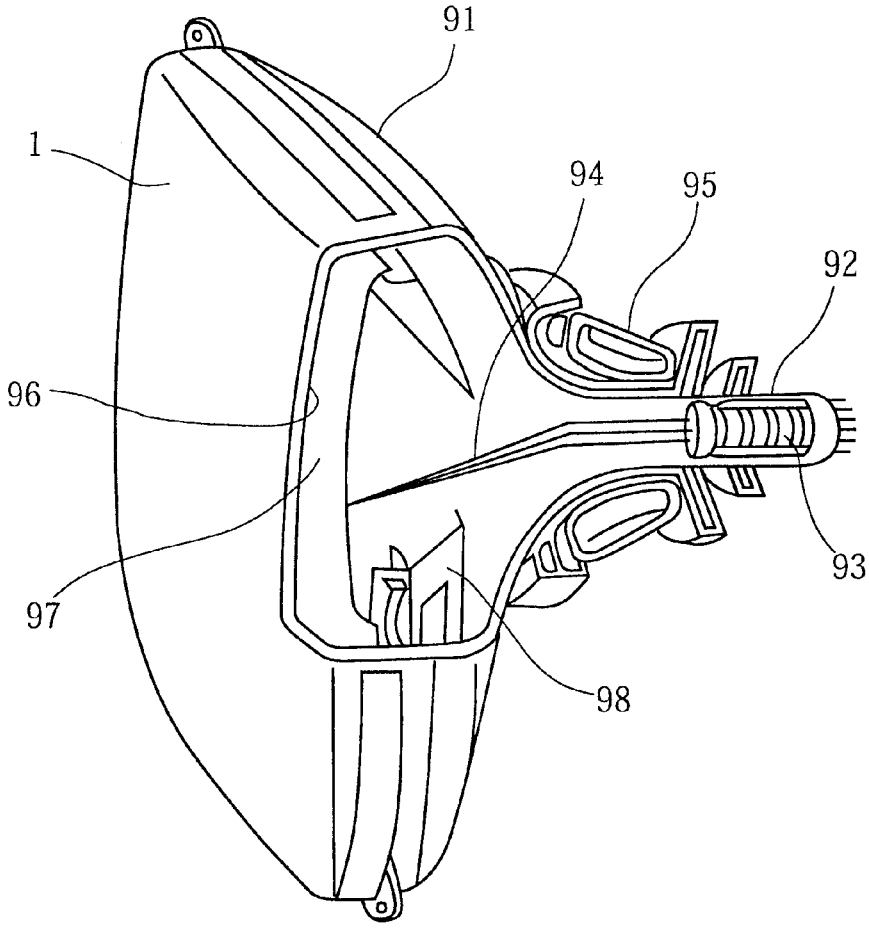
FIG. 1 is a perspective view of a conventional color CRT, which has bee n partially cut away to show its interior.
Figure 2:
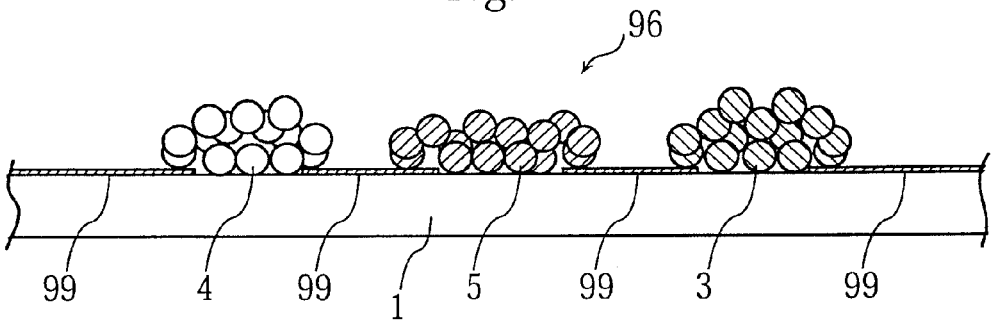
FIG. 2 is an enlargement in cross-section of one part of the front substrate 1, used to illustrate the construction of the phosphor layer 96.
Figure 3A:
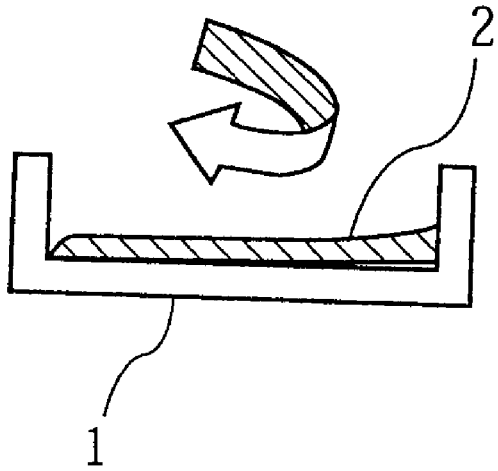
FIGS. 3A and 3B show a conventional slurry method.
Figure 3B:
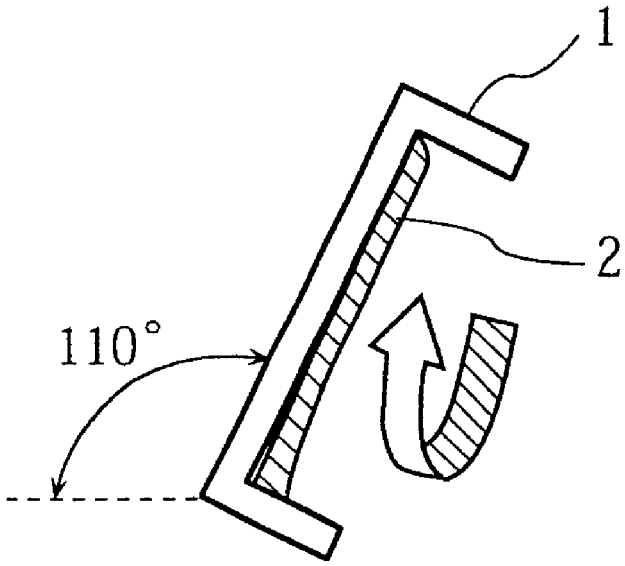
Figure 4:
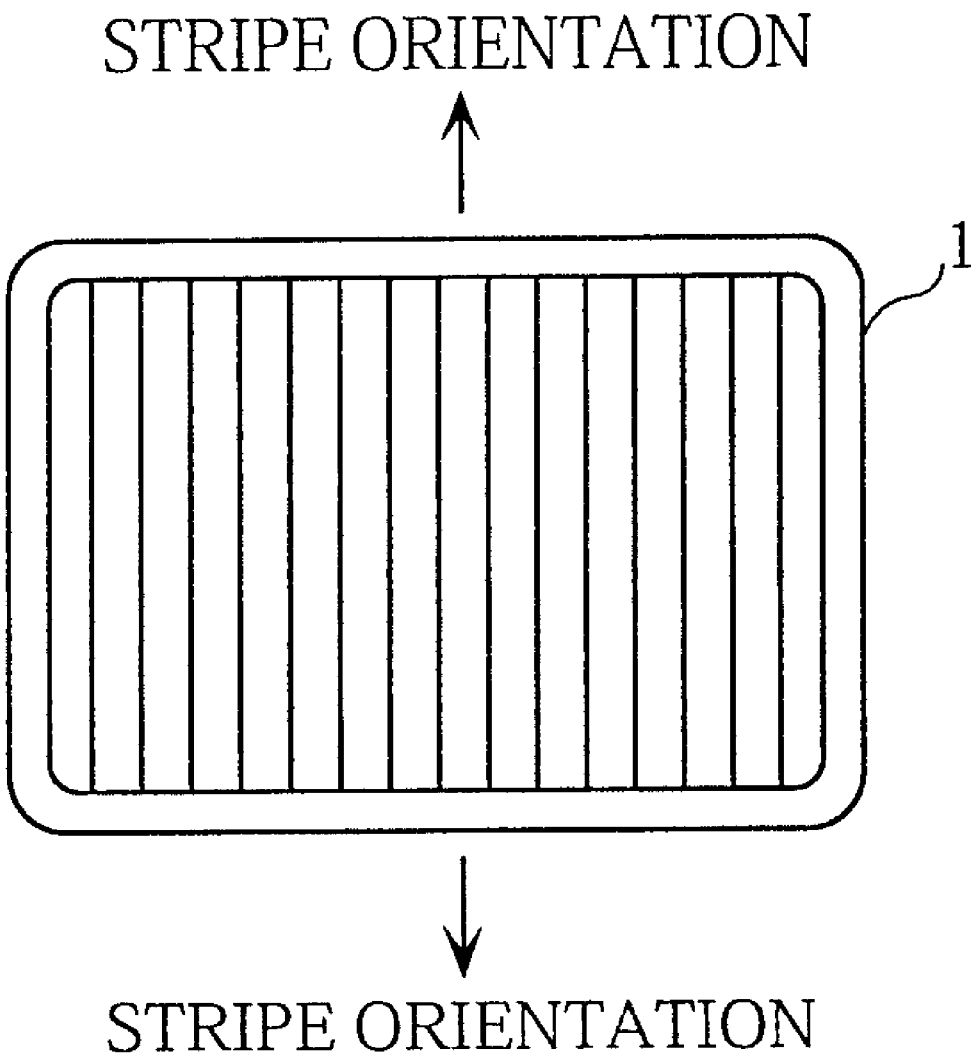
FIG. 4 shows the stripe orientation.
Figure 11A:
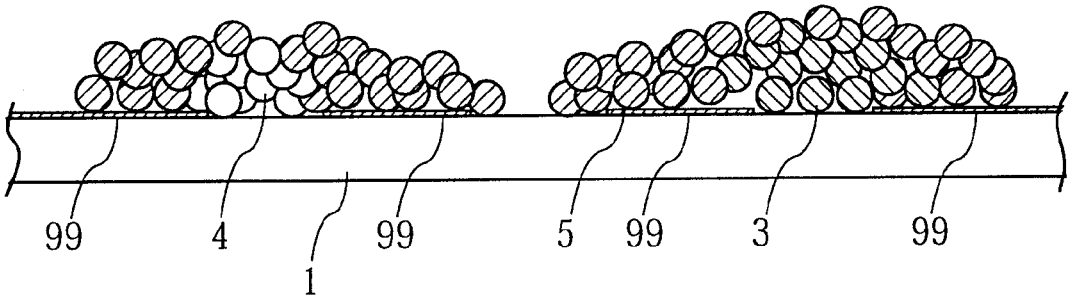
FIGS. 11A and 11B are outline cross-sections of one part of the front substrate 1, showing the concentration of phosphor particles 5 having the third color existing after the conclusion of a spinning process performed in a comparative example to the first embodiment, where the tilt angle during the draining process and the spinning process is the same.
Figure 11B:
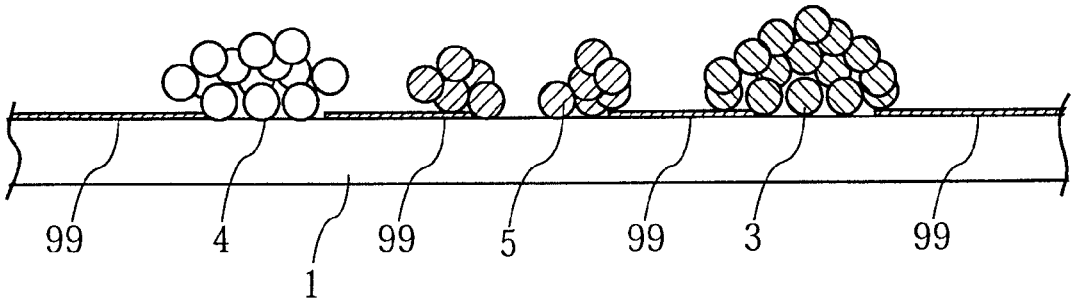

In the comparative example, the centrifugal force created during the high-speed rotation of the spinning process causes the phosphor particles 5 to migrate across the inner surface of the front substrate 1. Here, as shown in FIG. 11A, the phosphor particles 5 are deposited between the stripes of phosphor particles 3 of a first color and phosphor particles 4 of a second color, so that the movement of the phosphor particles 5 over the inner surface of the front substrate 1 is restricted in an orientation orthogonal to the stripes of the phosphor particles 3 and 4, but not in an orientation parallel to the stripes of the phosphor particles 3 and 4. Meanwhile, if points an equal radius away from the central point of the front substrate 1 are compared, the force exerted on stripes in the parallel orientation is stronger nearer to the center of the front substrate 1. Additionally, since the inner surface of the front substrate 1 is facing downwards at this point, the force of gravity causes the phosphor particles 5 to be lifted up from the surface of the front substrate 1. These two forces operate in tandem, with the result that the phosphor particles 5 in the parts of stripes nearer to the central part of the inner surface move further in the stripe orientation shown in FIG. 4, and the concentration of phosphor particles 5 is lower in the central part of the inner surface of the front substrate 1, as shown in FIG. 11B.

When the method in this embodiment is used, however, the tilt angle θ during the draining process is set at 110°, so that sufficient excess slurry can be drained off without creating irregularities (FIG. 9B), and then, in a continuous motion, the tilt angle θ is reduced to 100° and the spinning process performed (FIG. 9C). This restricts the gravity-influenced loosening of phosphor particles 5 from the inner surface of the front substrate 1, thereby greatly improving the evenness of particle concentration over the comparative example, as can be seen from FIG. 10.

Since one of the reasons for the improvement in the evenness of particle concentration described above is the restriction of the gravity-influenced loosening of phosphor particles from the front substrate 1, a reduction of the tilt angle θ in the spinning process is desirable. A tilt angle θ of 95° was found to be particularly effective at this point in improving the evenness of phosphor particle concentration. A further reduction in the tilt angle θ is possible, but it was found that a tilt angle θ exceeding 90° enabled more effective removal of excess slurry during the spinning process.

Meanwhile, it was found that irregularities in phosphor particle concentration were not generated when a tilt angle θ of 105° or more was used in the draining process. It is desirable that the tilt angle θ be set as large as possible in the draining process in order to achieve satisfactory drainage of slurry. However, the size of the tilt angle θ is limited by other factors. If the tilt angle θ is too large when the draining process is performed, the influence of gravity on the phosphor particles causes them to be loosened, so that even if the tilt angle θ is reduced when the spinning process is performed, those particles that have already been loosened migrate in the stripe orientation during the spinning process. As a result of these various factors, the tilt angle θ should preferably be set at between 105° and 130° when the draining process is performed.

Furthermore, the upper limit of the tilt angle θ used in the spinning process was found to be about 110° when the inner surface with a curvature radius of 10000 mm disclosed in the present embodiment was used. Should the method of this invention be applied to a front substrate 1 having a conventional inner surface with a small curvature radius, however, the tilt angle θ used for the spinning process may be as large as 130°.

Furthermore, if the difference between the tilt angle θ for the draining process and the tilt angle θ for the spinning process is too large, there is a greater likelihood that the phosphor slurry 2 adhering to the barrier wall surfaces of the front substrate 1 will splatter onto the inner surface when the swift change to the spinning process is made, thereby generating irregularities in the concentration of the phosphor particles. The inventors have determined through their research that the difference between the tilt angle θ in the draining and spinning processes should preferably be no less than 5° and no more than 20°.

Second Embodiment

The following is a description of a second embodiment of the present invention. In this embodiment, the method of the present invention is applied to the formation of the phosphor stripe pattern for a second color.

Once a phosphor pattern in a first color has been formed, a phosphor layer of the second color is obtained by performing the application, draining and spinning processes using the control process explained in the first embodiment, followed by a drying process and an exposure/developing process.

Figure 12A:
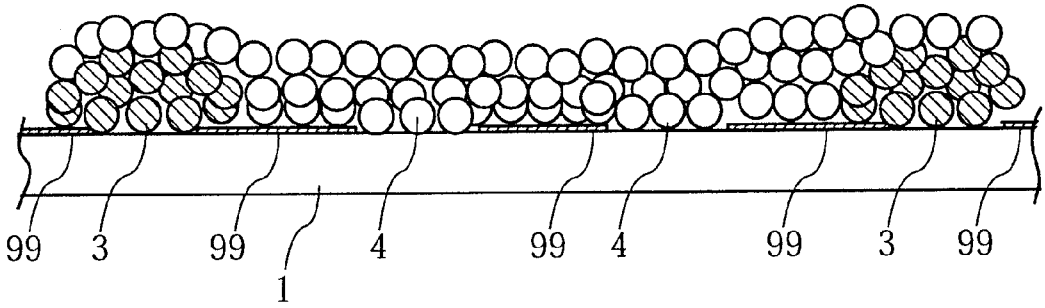
FIGS. 12A and 12B are outline cross-sections of one part of the front substrate 1, showing the concentration of phosphor particles 4 having a second color after the conclusion of the spinning process performed in the second embodiment of the invention.
Figure 12B:
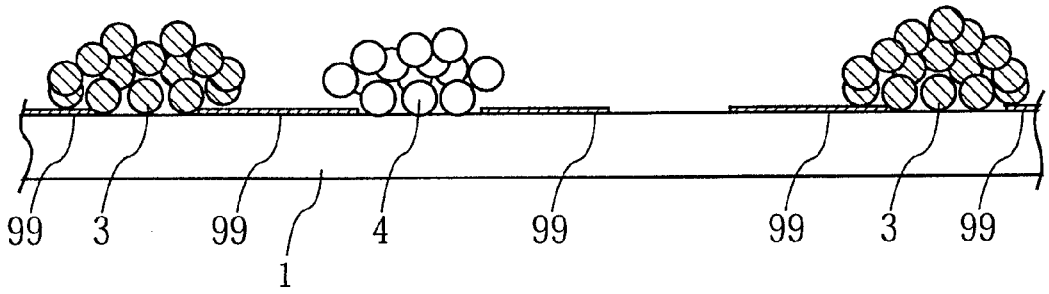

FIGS. 12A and 12B are outline cross-sections of one part of the front substrate 1, showing the concentration of phosphor particles after the conclusion of the spinning process in this embodiment, using phosphor slurry 2 for the second color.

Figure 13A:
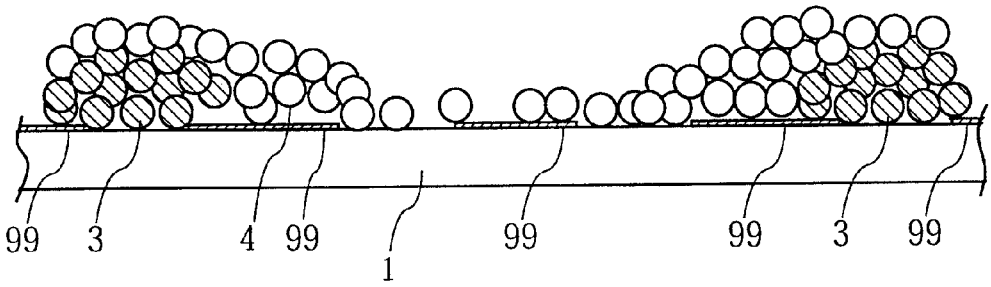
FIGS. 13A and 13B are outline cross-sections of the front substrate 1 showing the concentration of phosphor particles 4 having a second color after the conclusion of the spinning process performed in a comparative example to the second embodiment, where the tilt angle during the draining process and the spinning process is the same.
Figure 13B:
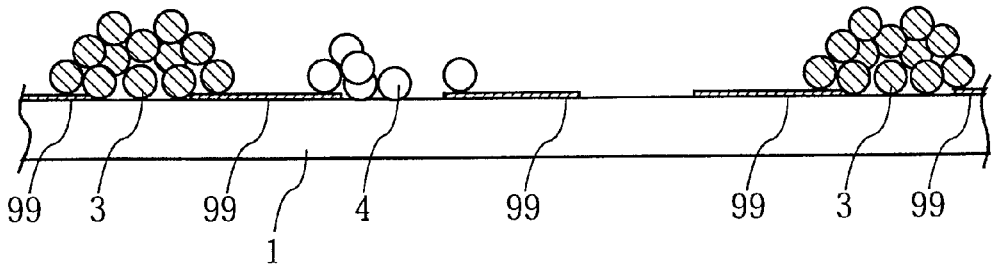

FIGS. 13A and 13B, like FIGS. 11A and 11B in the first embodiment, show a comparative example in which the tilt angle θ for both the draining and spinning processes is 110°.

In the comparative example, as in the first embodiment, the centrifugal force generated during the high-speed rotation of the spinning process forces the phosphor particles to migrate across the inner surface of the front substrate 1. The phosphor particles 4 in the second color have been deposited between the phosphor stripes 3 of the first color, so that at this point, the movement of the phosphor particles 2 in an orientation at right angles to the phosphor stripes 3 is restricted, but the movement of the phosphor particles 2 in an orientation parallel with the phosphor stripes 3 is not restricted. Furthermore, when points an equal radius from the central point of the front substrate 1 are examined, the parts of stripes nearer to the center are found to be under greater pressure to move in the parallel orientation. Since the substrate 1 is facing downwards at this point, gravity causes phosphor particles to be loosened from the surface of the front substrate 1. These two effects work in tandem, causing in phosphor particles nearer to the center to exhibit greater movement in the orientation parallel to the stripe pattern, and the evenness of phosphor particle concentration worsens, as shown in FIG. 13B.

In the present embodiment, however, the tilt angle θ during the draining process is set at 110°, so that sufficient excess slurry can be drained off without creating irregularities (FIG. 9B), and then, in a continuous motion, the tilt angle θ is reduced to 100° and the spinning process performed (FIG. 9C). This enables the loosening of phosphor particles to be restricted, as shown in FIG. 12A, and greatly improves the evenness of concentration of the phosphor particles over the comparative example (FIG. 12B). If the tilt angle θ in the spinning process is set at 95°, the evenness of phosphor particle concentration is improved still further, in the same way as in the first embodiment.

As in the first embodiment, it was found that irregularities in phosphor particle concentration were not generated when a tilt angle θ of 105° or more was used during the draining process. Furthermore, the tilt angle θ during the draining process should preferably be set as large as is possible without causing phosphor particles that have been poured onto.the inner surface to drop off. In other respects, such as the size of the tilt angle θ during the spinning process and the difference in the size of the tilt angle θ for the draining and spinning processes, this embodiment can be said to be the same as the first embodiment.

If the method of the invention is used, irregulaties in the concentration of phosphor particles on the inner surface of the front substrate 1 can be reduced. The front glass substrate can then be assembled together with the glass funnel, glass neck and other parts to produce a color CRT in which disparities in the luminance at various points on the screen have been reduced and white uniformity improved.

Although the present invention has been fully described by way of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A method for manufacturing a glass substrate on one surface of which a phosphor layer has been formed, the glass substrate being used for a front panel of a color cathode ray tube, and the manufacturing method comprising:

an application process for applying, onto an inner surface of a glass substrate on which a phosphor pattern in at least one color has already been formed, a phosphor slurry of another color;

a spreading process for rotating the glass substrate about an axis located at the approximate center of the inner surface to make the phosphor slurry spread out over the inner surface of the glass substrate;

a draining process for tilting the glass substrate to a first tilt angle of more than 90° to drain excess slurry off the inner surface of the glass substrate, a tilt angle being formed between a vertical axis and an axis orthogonal to an outer surface of the glass substrate; and a spinning process for returning the glass substrate to a second tilt angle smaller than the first tilt angle, and rotating the glass substrate.

2. The glass substrate manufacturing method of claim 1, wherein in the application process, the phosphor slurry is applied to the approximate center of the inner surface of the glass substrate.

3. The glass substrate manufacturing method of claim 2, wherein in the spreading process, the glass substrate is tilted at a specified tilt angle when rotation is performed.

4. The glass substrate manufacturing method of claim 1, wherein the first tilt angle does not exceed 130°.

5. The glass substrate manufacturing method of claim 4, wherein the first tilt angle is no less than 105°.

6. The glass substrate manufacturing method of claim 1, wherein in the draining process, the glass substrate is rotated at A rotation speed slower than the rotation speed used in the spinning process.

7. The glass substrate manufacturing method of claim 6 wherein the rotation speed used in the spinning process is at least 10 times faster than the rotation speed during the spreading process.

8. The glass substrate manufacturing method of claim 7 further including reducing the rotation speed after the spinning process to a rotation speed above the spreading process rotation speed.

9. The glass substrate manufacturing method of claim 1, wherein the second tilt angle exceeds 90°.

10. The glass substrate manufacturing method of claim 1, wherein the second tilt angle is no more than 130°.

11. The glass substrate manufacturing method of claim 1, wherein a curvature radius of the inner surface of the glass substrate is approximately 10000 mm, and the second tilt angle is no more than 110°.

12. The glass substrate manufacturing method of claim 1, wherein the difference between the first and second tilt angles is no less than 5° and no more than 20°.

13. A color cathode ray tube manufacturing method comprising:

an application process for applying, onto an inner surface of a glass substrate on which a phosphor pattern in at least one color has already been formed, a phosphor slurry of another color, the glass substrate being for use as the front panel of a cathode ray tube;

a spreading process for rotating the glass substrate about an axis located at the approximate center of the inner surface to make the phosphor slurry spread out over the inner surface of the glass substrate;

a draining process for tilting the glass substrate to a specified tilt angle of more than 90° to drain excess slurry off the inner surface of the glass substrate, the tilt angle being formed between a vertical axis and an axis orthogonal to an outer surface of the glass substrate;

a spinning process for returning the glass substrate to a tilt angle smaller than the specified tilt angle for the draining process, and rotating the glass substrate at a specified rotation speed; and a cathode ray tube assembly process in which, after a phosphor layer including phosphors in a specified plurality of colors has been formed on the glass substrate, the glass substrate is fitted together with other glass parts to assemble the cathode ray tube, and a near vacuum is formed in the cathode ray tube.

* * * * *